US006601892B2

(12) United States Patent
Scarborough

(10) Patent No.: US 6,601,892 B2
(45) Date of Patent: Aug. 5, 2003

(54) GRAVITY GRIP

(76) Inventor: Tom Scarborough, 5401 27th St., Lubbock, TX (US) 79407

( * ) Notice: Subject to any disclaimer, the term of this patent is extended or adjusted under 35 U.S.C. 154(b) by 0 days.

(21) Appl. No.: 10/104,959

(22) Filed: Mar. 21, 2002

(65) Prior Publication Data

US 2002/0190533 A1 Dec. 19, 2002

Related U.S. Application Data

(60) Provisional application No. 60/295,390, filed on May 31, 2001.

(51) Int. Cl.[7] ..... B66C 1/42

(52) U.S. Cl. ..... 294/103.1; 294/62; 294/63.1; 294/82.13; 294/104

(58) Field of Search ..... 294/62, 63.1, 82.13, 294/103.1, 104; 414/621, 622

(56) References Cited

U.S. PATENT DOCUMENTS

| | | | | | |
|---|---|---|---|---|---|
| 831,424 | A | * | 9/1906 | Pravel | 294/82.13 |
| 1,272,359 | A | * | 7/1918 | Bell | 294/103.1 |
| 3,264,026 | A | | 8/1966 | Hansen | |
| 3,885,692 | A | | 5/1975 | Anderson, Jr. | |
| 4,194,868 | A | | 3/1980 | Walker et al. | |
| 4,359,241 | A | * | 11/1982 | Kistner | 294/82.13 |
| 4,489,970 | A | * | 12/1984 | Henke | 294/67.22 |
| 4,545,609 | A | * | 10/1985 | Pasquazzi et al. | 294/104 |
| 5,484,256 | A | * | 1/1996 | Claassen | 414/790.8 |
| 5,642,979 | A | | 7/1997 | Cullen et al. | |
| 5,746,564 | A | | 5/1998 | McPherson | |

FOREIGN PATENT DOCUMENTS

| | | | | |
|---|---|---|---|---|
| JP | 03216405 A | * | 9/1991 | B65G/7/12 |

* cited by examiner

*Primary Examiner*—Eileen D. Lillis
*Assistant Examiner*—Michael Lowe
(74) *Attorney, Agent, or Firm*—Wendell Coffee

(57) ABSTRACT

A machine for lifting and moving heavy slabs includes two channels connected only by a cable. The channels are placed against opposite edges of a slab. Each channel has a lower flange which is beveled so that the flange will scoop under the edge of the slab when moved toward the opposing channel. The channels are moved by attaching the cable to one channel and pulling the cable upward from the sheave on the other channel. Further lifting of the cable lifts the channels and the slab for moving.

4 Claims, 4 Drawing Sheets

GRAVITY GRIP

REFERENCE TO PROVISIONAL PATENT APPLICATION

The applicant claims the benefit of his U.S. Provisional Application No. 60/295,390, filed May 31, 2001.

BACKGROUND OF THE INVENTION

Field of the Invention

This invention relates to moving large slabs. A typical slab to be moved is a stone slab 9 inches thick measuring 60 inches wide and 80 inches long. A typical operation would be placing stone slabs in a garden or in walkways.

This machine, with its combination of mechanisms, can be used for the purpose of handling heavy dimensional slabs of stone, concrete, steel, or other massive materials such as boxes, packages, and crates, in the following (but not limited to) operations: loading, unloading, placing dry walls, transporting, placing in stacks, placing in storage, and tilt-up operations. Landscape gardeners have ordinary skill in the art.

SUMMARY OF THE INVENTION (1) Progressive Contribution to the Art

The principle of operations is grabbing the slab by moving cuffs together. Two cuffs are moved together by tightening a cable horizontally by vertically pulling on the cable. The cable is attached to the top portion of a travel cuff, then passed under a pulley attached to a lift cuff, then up through a guide ring which is attached to the upper portion of a stabilizing mast, which is attached to the lift cuff.

Gravity plays an important factor in the operation of this machine. The heavier the slab to be lifted and transported; the tighter the grip on the slab.

The aforementioned pulley allows the vertical lift energy to be directed from a vertical pull to a horizontal pull, thus tightening the grip of the lift cuff and the opposing travel cuff.

(2) Objects of this Invention

An object of this invention is to fasten a lift unit to a heavy slab; then lift, move, and place the slab in a new location.

Another object is to provide equipment to fasten, lift, and release a slab as described above.

Further objects are to achieve the above with devices that are sturdy, compact, durable, simple, safe, efficient, versatile, ecologically compatible, low maintenance, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

Further objects are to achieve the above with equipment that is easy to store, has a long storage life, is safe, versatile, efficient, stable and reliable, yet is inexpensive and easy to manufacture and operate.

The specific nature of the invention, as well as other objects, uses, and advantages thereof, will clearly appear from the following description and from the accompanying drawings, the different views of which are not necessarily scale drawings.

CATALOGUE OF ELEMENTS

As an aid to correlating the terms of the claims to the exemplary drawing(s), the following catalog of elements and steps is provided:

| | | | |
|---|---|---|---|
| 8: | Lifting Unit | 26: | Lower Lip, Travel |
| 9: | Gravity Grip | 28: | Beveled Scoop, Travel |
| 10: | Lift Unit | 30: | Travel Plate |
| 12: | Eye | 32: | Sheave |
| 14: | Cable | 34: | Support Plates |
| 16: | Mast | 36: | Hand Hold |
| 18: | Lift Cuff | 38: | Cable Tube |
| 19: | Lift Plate | 40: | Stop |
| 20: | Bottom Lip, Lift | 42: | Slab |
| 22: | Beveled Scoop, Lift | 44: | Supporting Surface |
| 23: | Travel Unit | 46: | Loop |
| 24: | Travel Cuff | | |

DESCRIPTION OF THE PREFERRED EMBODIMENT

Figure 4:
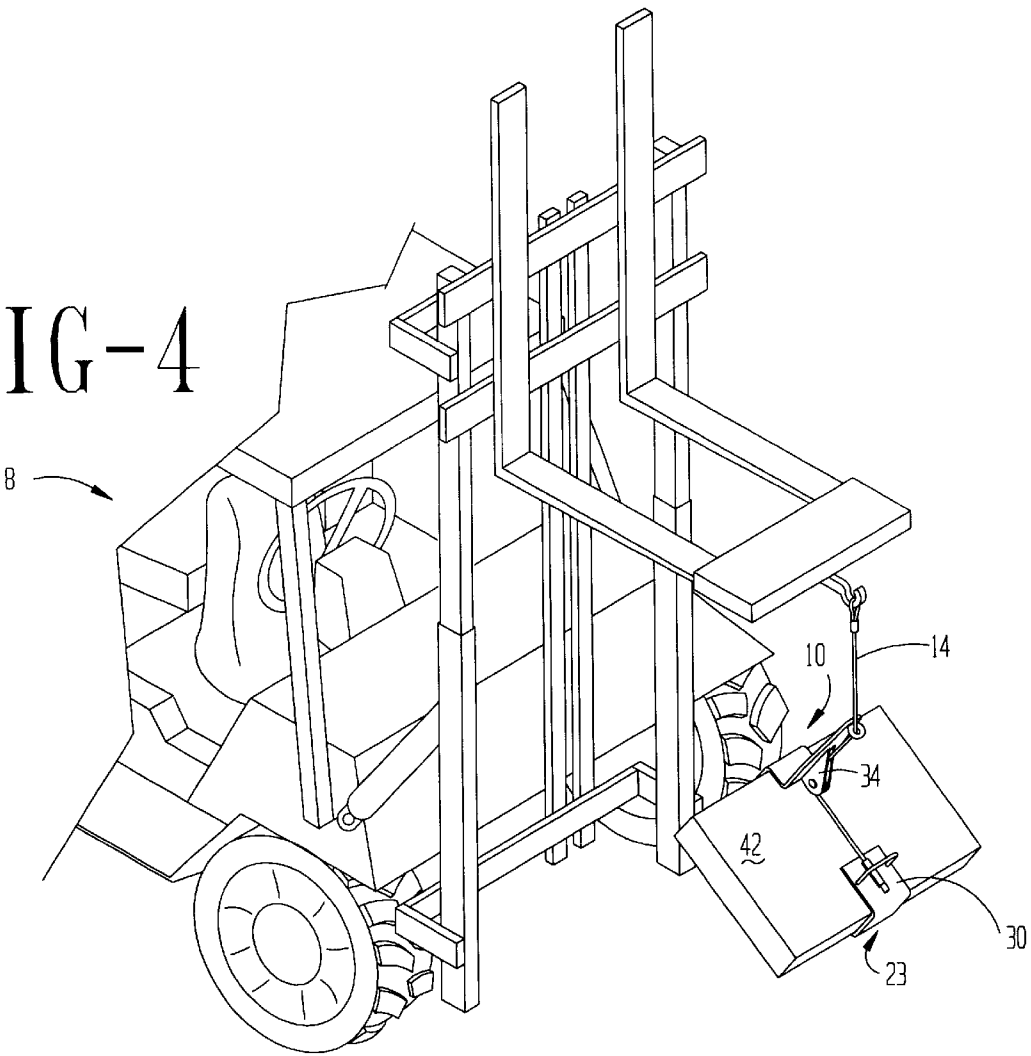
FIG. 4 is a perspective view of the equipment with a slab fastened with the equipment and slab being lifted by a forklift vehicle.

Referring to FIG. 4, there may be seen a lifting unit 8 in the form of a forklift raising slab 42 of cut stone or any other extremely heavy material. Usually the thinnest portion of the slab would be at least 60% of the thickest portion of the slab.

The invention is gravity grip 9 which connects cable 14 to the slab. It will be understood that once the cable is attached to the slab, the gravity grip may be lifted by any convenient lifting unit; for example, a tripod with block and tackle or an elevated winch or a boom extending from the rear of a truck.

Figure 1:
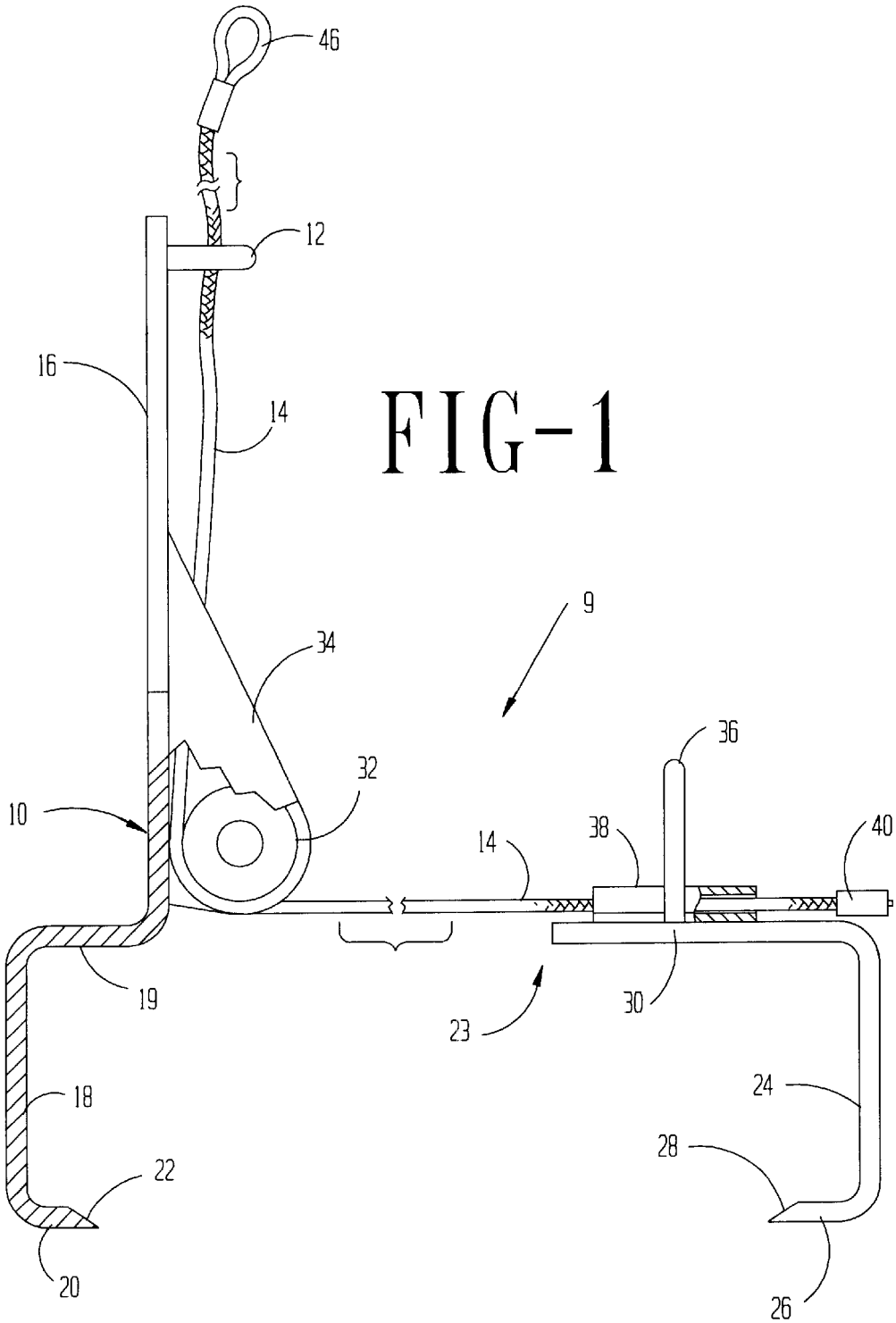
FIG. 1 is a side elevational view of equipment of this invention with parts broken away to show construction.
Figure 2:
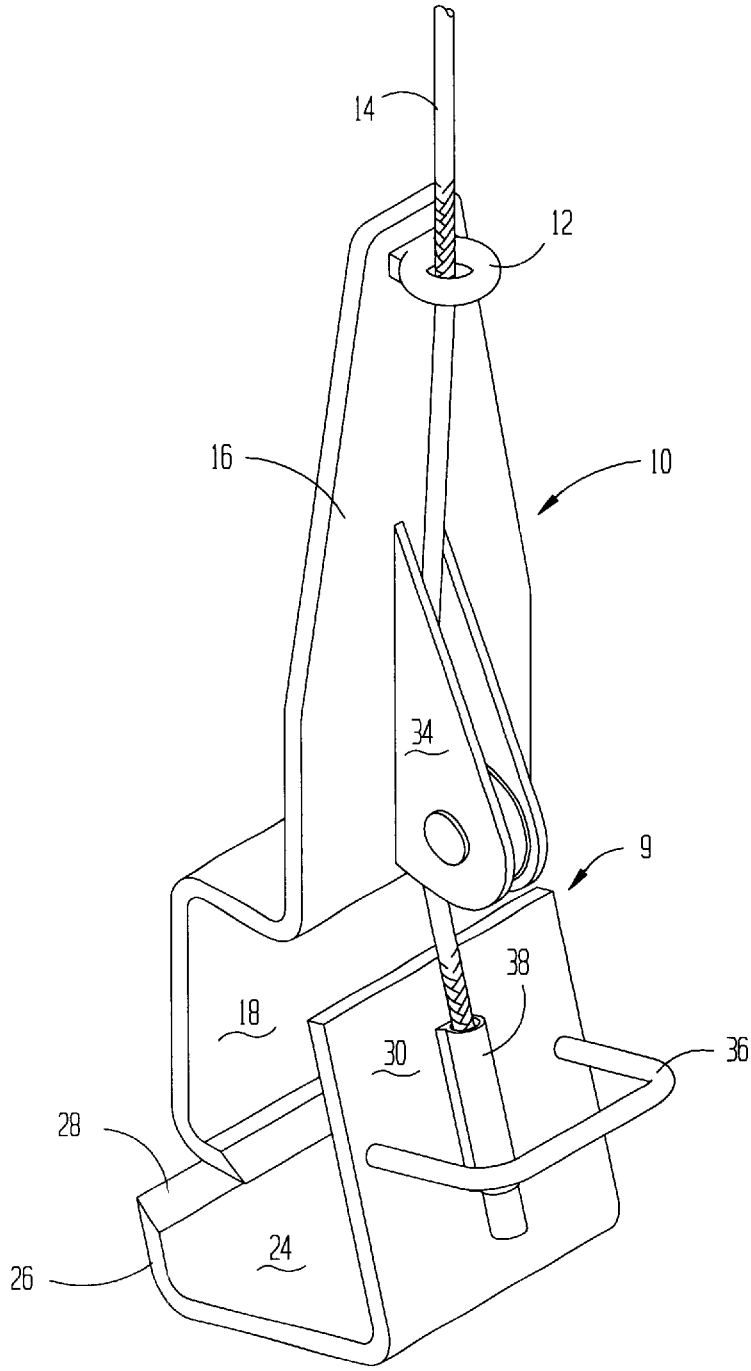
FIG. 2 shows the equipment as described in this invention in the compact storage confirmation.

FIGS. 1 and 2 show the gravity grip 9. A major part of the gravity grip is lift unit 10. The lift unit 10 includes guide ring or eye 12 on top of mast 16 to guide the cable 14 to the lifting unit. The lower part of the lift unit 10 includes lift cuff 18. Bottom lip 20 of the lift cuff has beveled scoop 22.

The lift cuff 18 is basically a channel with a web connecting an upper flange identified as lift plate 19 and a lower flange identified as the lift bottom lip 20.

As seen in both FIG. 1 and FIG. 2, the lift cuff 18 with the bottom lift lip 20, lift plate 19, and mast 16 are fabricated from a single plate of metal in this embodiment.

Travel unit 23 includes travel cuff 24 which also includes travel plate 30, travel lower lip 26, and travel beveled scoop 28. As explained above, the travel cuff 24 is also basically a channel. Travel plate 30, which forms upper flange of the travel cuff 24, extends for a distance equal to or slightly greater than the height or thickness of the travel cuff 24 which is the same as the height of lift cuff 18.

The cable 14 extends downward from its top loop 46 through the eye 12 to between the mast and sheave 32. The sheave forms a turn unit for the cable. The sheave is attached to the mast 16 by support plates 34 which are welded to the mast 16. The cable 14 extends from under the sheave through hand hold 36 attached to the top of the travel plate 30. Cable tube 38 is securely attached to the travel plate 30 under the center of the hand hold 36. The cable 14 extends through the tube 38 to stop 40 on the end of the cable, thus the cable is fixed to the travel unit 23.

Figure 3:
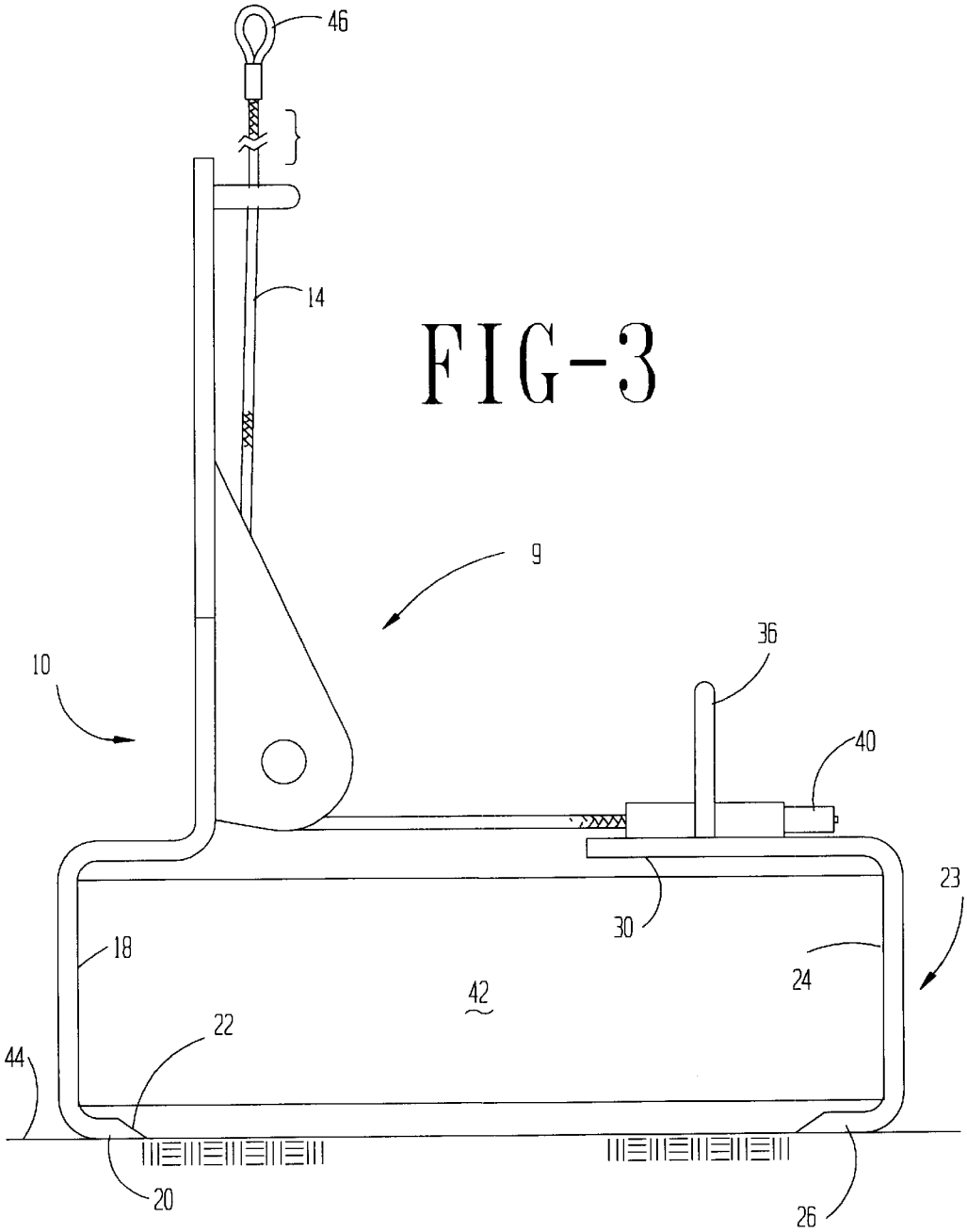
FIG. 3 is a side elevational view, similar to FIG. 1, showing the equipment with a slab engaged in the equipment in a position ready to be transported.

Referring to FIG. 3, there may be seen the gravity grip 9 engaged with the slab 42. It will be understood that with the lift unit 10 and travel unit 23 placed with the lips 20 and 26 upon supporting surface 44 and against the slab 42; that the slab 42 may be lifted into the cuffs by the movement of the scoops 22 and 28 against the slab; that with tension on the cable, the slab is caught or captured. The travel unit 23 may be maneuvered by hand hold 36 to an opposite side of the slab 42 from lift unit 10. With the slab 42 thus engaged, the cable 14 and slab 42 may be lifted by loop 46.

Although the sheave 32 is the desired method of changing the direction of tension of the cable, other turn units are available.

The FIG. 2 is a perspective view of the total gravity grip 9 in its collapsed or storage position.

In greater detail, the slabs to be lifted are primarily stone slabs in standard thickness: specifically 4",6",9",12",16" and 24". The thickness may vary by ±½". For example the gravity grip for 9" slabs would have a space from the lower lip 26 to the plate 30 of 9¾. Thereby, the cuffs could grab or capture a slab of either 8½" to 9½ "thick with ease.

The 9" gravity grip could also handle a 6" slab, although using 6" gravity grip is preferable. Each gravity grip 9 would have a space ¾" greater from lip to plate (the channel flanges) than the designated unit. Also, each gravity grip 9 may be used to lift a slab one step thinner than the designated slap. For example, the 16" gravity grip could lift a 12" slab or a 6" gravity grip could lift a 4" slab. The preferred use is to lift each standard thickness with a gravity grip made for that standard size. The cable tube 38 has its attachment about 1" from the edge of the travel plate 30. This permits easier handling.

Referring to FIG. 4 of the drawings, it may be seen that the center of gravity of the slab and gravity grip is vertically below the eye 12. Analysis will show the deviation from horizontal of the lifted slab will depend upon the distance the eye 12 is above the plane of the slab and the position of eye 12 on a line parallel to the plane of the slab.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to point out the advantages and the progressive contribution to the slab handling arts and to enable one skilled in the art to make and use the invention. The limits of the invention and the bounds of the patent protection are measured by and defined in the following claims.

What is claimed is:

1. A grasping unit for transporting a rigid, heavy slab comprising:

a) a lift channel, b) a travel channel, c) each channel having an upper flange and a lower flange connected by a web, d) a cable fixed to the upper flange of the travel channel, e) a sheave journaled to the lift channel above the upper flange, f) a mast on the lift channel extending upward from the lift channel, and g) a cable guide near the top of the mast, and h) the cable extending from the travel channel to under the sheave and between the mast and the sheave and through the guide.

2. The grasping unit as stated in claim 1 further comprising:

i) the lower flange beveled with the edge along the bottom of the lower flange and a slope to the top of the lower flange of each channel.

3. The grasping unit as stated in claim 1 further comprising:

i) channel is fabricated from a single plate of metal.

4. The grasping unit as stated in claim 3 further comprising:

j) the lift channel and mast are fabricated from a single plate of metal.

* * * * *